US006375783B1

(12) United States Patent
Davis

(10) Patent No.: US 6,375,783 B1
(45) Date of Patent: Apr. 23, 2002

(54) METHOD OF TRANSFERRING A SUBLIMABLE DYESTUFF ART IMAGE ONTO THE CURVED OUTER SURFACE OF A BILLIARD BALL

(76) Inventor: Elbert Davis, #91 Blue Lagoon, Laguna Beach, CA (US) 92651

( * ) Notice: Subject to any disclaimer, the term of this patent is extended or adjusted under 35 U.S.C. 154(b) by 0 days.

(21) Appl. No.: 09/531,401

(22) Filed: Mar. 20, 2000

(51) Int. Cl.[7] ..... A63B 45/00; B44C 1/165

(52) U.S. Cl. ..... 156/230; 156/211; 156/235; 156/237; 156/238; 156/240; 156/256; 156/293; 156/278; 40/327; 473/52; 473/152; 473/351

(58) Field of Search ..... 473/52, 125, 351; 156/235, 237, 238, 240, 211, 257, 268, 293, 256, 230, 278; 40/327

(56) References Cited

U.S. PATENT DOCUMENTS

| | | | | | |
|---|---|---|---|---|---|
| 513,876 | A | * | 1/1894 | Burt | 40/327 |
| 2,899,765 | A | * | 8/1959 | Fuller | 156/59 |
| 5,846,138 | A | * | 12/1998 | Borden et al. | 473/54 |

FOREIGN PATENT DOCUMENTS

GB 2 117 320 A * 10/1983

* cited by examiner

*Primary Examiner*—Linda Gray
(74) *Attorney, Agent, or Firm*—Charles C Logan, II

(57) ABSTRACT

The method of transferring a sublimable dyestuff art image onto the curved outer surface of a billiard ball. The spherically shaped polyester billiard ball is initially molded with at least one recess having a first predetermined configuration formed in its curved outer surface. The first predetermined configuration would be either that of a heart or a spade such as found in a deck of cards and. the billiard ball would be made of material having a color that is not white. A plug made of styrene polyester resin heat cured material is then inserted into the recess. A plug would have the same first predetermined configuration. The surface of the plug must be receptive to sublimable dyestuff. The plug is then heat cured in the recess thereby providing a billiard with a substantially spherical outer surface. In the meantime a first lithographic art image has been formed on an auxiliary carrier web and the lithographic art image is made of sublimable dyestuff. The art image also has an outer edge having substantially the shape of the first predetermined first configuration. Inwardly extending cuts are made around the outer edge of the perimeter of the first lithographic art image. At this point the first lithographic art image with its sublimable dyestuff is hot pressed heat transfer printed onto a curved outer surface of the plug.

20 Claims, 1 Drawing Sheet

METHOD OF TRANSFERRING A SUBLIMABLE DYESTUFF ART IMAGE ONTO THE CURVED OUTER SURFACE OF A BILLIARD BALL

BACKGROUND OF THE INVENTION

The invention relates to a process involving the heat-induced transfer of sublimable dyestuff images and more specifically to applying such an image to the curved surface of a billiard ball.

Various surfaces may be decorated by a sublimatic transfer printing process. Such printing processes involve, as a first step, full color lithographic printing on paper using so called "dispersal" dyes having the property of subliming or vaporizing to a gas when heated. A second step involves transferring the printed image under heat and, usually, pressure in a transfer press to a substrate form of material that is receptive to the sublimable ink. The inks are capable of being printed onto the paper by lithographic printing methods using etched gravure press cylinders and standard lithographic paper, so that one can obtain the high quality, four color reproduction achievable by these techniques.

Previously, sublimatic transfer processes have been found to be particularly useful in printing full color reproductions onto polyester fabrics. Excellent color quality and efficient transfer was possible with such fabrics, but at that time poor results were usually obtained on non-textile items such as wood, particle board, plastic sheets, leather, rubber and other organic or natural materials. Also at that time no transfer at all was feasible on glass fabric, sheet glass, metal surfaces, marble or other inorganic materials. The inventor in his U.S. Pat. No. 4,395,263 provided a method for sublimatic ink transfer to any of the foregoing substrates, whether organic or inorganic.

In attempting to follow the teachings of U.S. Pat. No. 4,395,263 in heat transfer printing lithographic art images of sublimable dyestuff onto the curved surface of billiard balls, certain difficulties were encountered.

The attempt to print heart shaped or spade shaped lithographic printed art work much more than ¾ inch to 1 inch in diameter on standard spherical billiard balls resulted in wrinkling of the lithopaper during the hot press transfer operation and an unsatisfactory jagged edge on the transferred images. The lithoprinter could offer no help and no flexible or elastic paper stock was available to solve the wrinkle problem.

It is an object of the invention to provide a novel method of transferring a sublimable dyestuff art image onto a curved outer surface of an object.

It is also an object of the invention to provide a novel method of transferring a sublimable dyestuff art image onto the curved outer surface of a billiard ball.

It is another object of the invention to provide a novel method of transferring a sublimable dyestuff art image onto the curved outer surface of a billiard ball without the transferred image having an unsatisfactory jagged edge produced by the wrinkling of the lithopaper during the hot press operation.

SUMMARY OF THE INVENTION

The invention relates to a method of transferring a sublimable dyestuff art image onto the curved outer surface of objects such as billiard balls, golf balls, tennis balls, bowling balls, telephones, toys, etc. One preferred embodiment would relate to the heat transfer printing of a sublimable dyestuff art image onto a billiard ball.

The invention was developed as a result of the development of the Poker Pool game that was conceived by George Emery. The game requires that the billiard balls have images on them corresponding to the four suits of cards in a deck of playing cards. Therefore, images of hearts and spades had to be applied to the curved outer surface of the billiard balls.

In working to overcome the wrinkling effect during the heat transfer process onto curved surfaces, it was discovered that this problem could be overcome. It was determined that by steel rule dye cutting the heart or spade shaped art work just slightly larger than the printed image and providing cuts extending in from the outside edge about 1/16–¼ inch, the segment between cuts overlap rather than wrinkle during the heat transfer printing process. Because of the subliming nature of the sublistatic printing process, a perfect smooth blending of the red heart or the black spade color results with no visible evidence detectable from the cut in the paper and no jagged edges are formed from wrinkling of the paper.

Another problem that had to be overcome was to provide a proper surface on the billiard balls for transferring the dyestuff by sublimation from the lithographic printed paper carrier. In the special case of billiard balls, many different colors including black are used. In order to print red hearts, black spades, and multi-colored art work on these various colored surfaces, it is necessary that the plug have a white background. This was accomplished by initially molding a spherically shaped polyester billiard ball with at least one recess having the predetermined configuration of a heart or a spade formed in its outer surface. This billiard ball would be made of a material having a color that is not white. The next step is that of inserting or forming a plug made of polyester resin material into the recess and the plug would have either the respective heart or spade configuration. As a further cost saving modification and simplification of the process, the white plugs may all be made in the heart configuration because the black tail of the lithographic art image of the black spade will print black on any colored ball and does not require a white plug background as do all the other colors in the art image. The plug would then be heat cured in the recess thereby providing the billiard with a substantially spherical outer surface. The plug would be of an opaque white material. The surface of the plug would then be coated with a clear alkyd resin and melamine formaldehyde resin.

In a separate operation, the lithographic art images of red hearts and black spades would be formed on an auxiliary carrier web. The lithographic art image would be made of sublimable dyestuff. The outer edge of the heart or spade shaped lithographic images would have inwardly extending cuts around the outside edge of the perimeter of the lithographic art image. These lithographic art images would then be applied to the outer surface of the plug and the operation of hot press heat transfer printing of the lithographic art image would occur thereby printing the sublimable dyestuff onto the curved outer surface of the plug.

Although this labor intensive process produces the most excellent results, a further modification and simplification of the process can be produced by the production of/or insertion of a heart or spade shaped titanium dioxide pigmented styrene polyester plug in the colored billiard ball in place of the support stratum of polyester resin previously described. The surface of the polyester resin plug may then be coated with the clear alkyd resin and melamine formaldehyde resin and heat cured to provide the laminate for transferring dyestuff by sublimation from the lithographic printed paper carrier.

A further modification and simplification of the process can be accomplished by changing the mixture of the titanium dioxide white pigmentation in the styrene polyester resin plug. This would be produced by reducing the amount of pigment to 8 parts plus or minus 6 per 100 parts of resin to provide a sufficient degree of translucency so that the top most clear layer alkyd resin and melamine formaldehyde resin may, as an option, be eliminated. Although this simplified process cannot produce the color intensity and depth of color of a photographic print as does the preferred laminated combination of a top transparent layer and a highly pigmented white base layer, the resulting color tones are acceptable and the simplification has the advantage of economy.

Another problem that had to be overcome relates to the problem of accurate registration of a red heart shaped print or a black spade shaped print on the white plugs in the various colored balls. If the red heart shaped print were the exact shape and size of the white heart shaped plug and absolutely perfect registration were possible, there would be no problem. With the slightest missed registration in any direction on any color other than the red ball, some of the white area would show and there would also be some dark border (for example red plus blue on a blue ball produces a purple border and red plus green on a green ball produces a black border, etc).

Making the red heart print smaller than the white plug would eliminate the off color border problem but leave an undesirable white border around the red heart print. The problem has been solved by providing a sublistatic ink border around the under sized red heart print of a color to match the color of the ball on which it is to be printed. This border would also be of a width sufficient to print the matching color in the white plug area as well as over printing the matching color onto the ball just outside of the white plug area. As a further cost saving modification and simplification, in the lithographic printing of the various art images, this border may be black for all colored balls (instead of a color to match the color of the ball on which it is to be printed). Thus the black border will print black on the white plugs and will also print black on all colored balls where it overprints on to the colored area.

The same basic approach is used with the oversized black spade art work except that it is not necessary to have a spade shaped white plug insert in the balls because the oversized black sublistatic ink art work will print black on any colored ball as well as on the white plug. In this case there is no missed registration problem and the oversized black spade art work will print a black spade shape over the white heart shape plugged including enough black border to hide any missed registration.

DESCRIPTION OF THE PREFERRED EMBODIMENT

Figure 1:
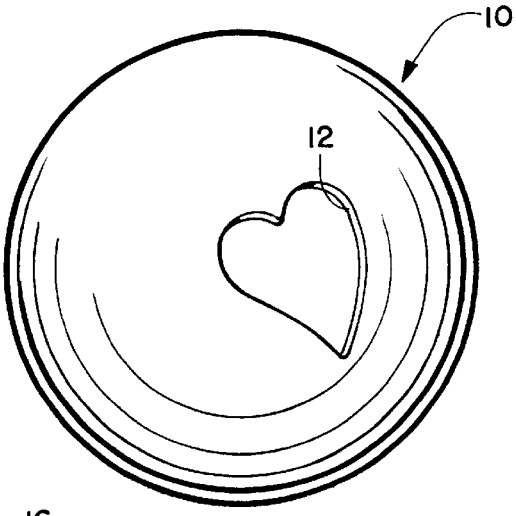
FIG. 1 is a front perspective view of a billiard ball having a recess formed in its curved outer surface.
Figure 2:
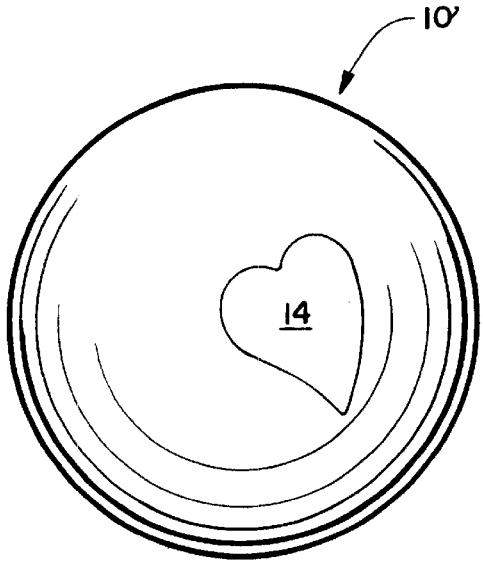
FIG. 2 is a front perspective view of the billiard ball having a plug inserted into its recess.

The method of transferring a sublimable dyestuff art image 10 onto the curved outer surface of an object such as a billiard ball will now be described by-referring to FIGS. 1–5 of the drawing. The billiard ball 10 would be molded of polyester resin material that is not white in color. It could be yellow, green, red, etc. Billiard ball 10 would be formed with a recess 12 in the shape of a heart. The depth of the recess would be in the range of 0.02–0.08 inches. FIG. 2 shows the billiard ball with a white plug 14 having been inserted into the recess 12.

Figure 3A:
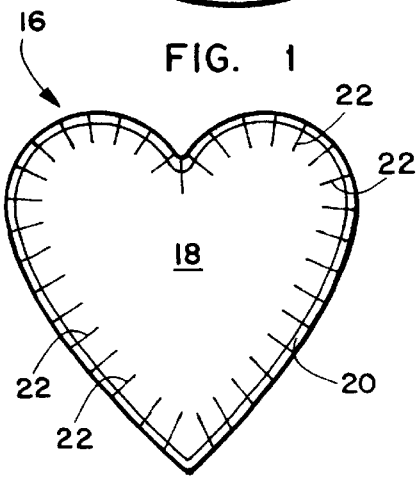
FIG. 3A is a front elevation view of a heart shaped lithographic art image made of sublimable dyestuff.
Figure 3B:
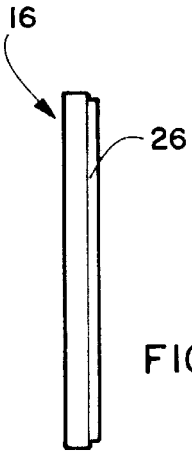
FIG. 3B is a schematic side elevation of a heart shaped lithographic art image made of sublimable dyestuff.

FIG. 3A is a front elevation view of a first lithographic art image 16 in the shape of a heart. It has a central portion 18 and a black border 20 extending around the perimeter of its outer edge. Cuts 22 extend inwardly from the outer edge of the lithographic art image around its entire perimeter. The length of these cuts is L1 is in the range of 1/16–1/4 inch. FIG. 3B is a schematic side elevation view of the lithographic art image 16 showing that it is mounted on a carrier web 26.

Figure 4:
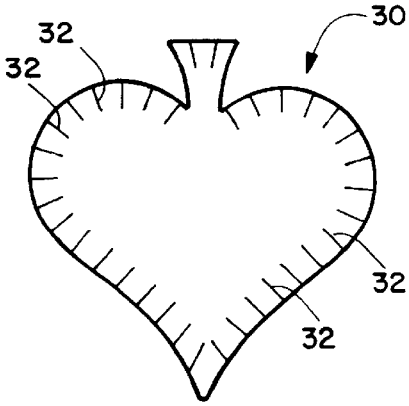
FIG. 4 is a front elevation view of a spade shaped lithographic art image made of sublimable dyestuff.

A lithographic art image 30 in the shape of a spade is illustrated in FIG. 4. It would be black in color and have cuts 32 extending inwardly around its entire perimeter. It would also be mounted on a carrier web.

Figure 5:
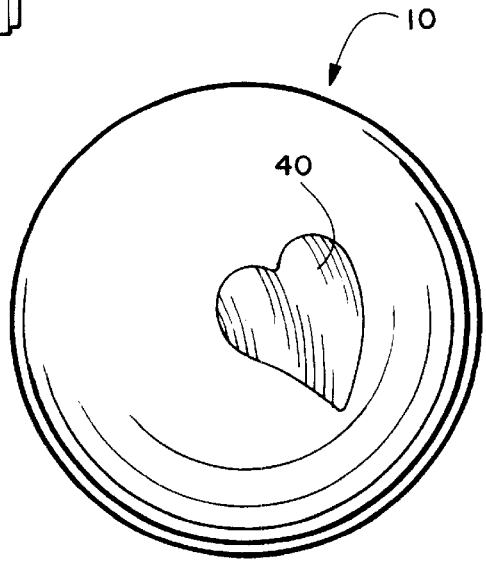
FIG. 5 is a front perspective view showing the lithographic art image having been transferred onto the plug.

The finished billiard ball is illustrated in FIG. 5 showing the red heart shaped transferred image 40 covering the white plug 14.

What is claimed is:

1. The method of transferring a sublimable dyestuff art image onto the curved outer surface of a billiard ball comprising the steps of:

(a) molding a spherically shaped polyester billiard ball with at least one recess having a first predetermined configuration formed in its curved outer surface, said billiard ball being made of a material having a color that is not white;

(b) inserting a plug made of white styrene polyester resin material into said at least one recess; said plug having said first predetermined configuration and a curved outer surface;

(c) the curved outer surface of said plug then being coated with a clear alkyd resin and melamine formaldehyde resin;

(d) said plug and coating then being heat cured thereby providing said billiard ball with a substantially spherical outer surface;

(e) forming a first lithographic art image on an auxiliary carrier web; said first lithographic art image being made of sublimable dyestuff; said first lithographic art image having an outer edge having substantially the shape of said first predetermined configuration;

(f) making inwardly extending cuts around the outside edge of the perimeter of said first lithographic art image; and (g) hot press heat transfer printing of said first lithographic art image and said sublimable dyestuff onto said curved outer surface of said plug.

2. The method of transferring a sublimable dyestuff art image onto the curved outer surface of a billiard ball as recited in claim 1 wherein said first predetermined configuration is in the shape of a heart.

3. The method of transferring a sublimable dyestuff art image onto the curved outer surface of a billiard ball as recited in claim 2 wherein said lithographic art image is a red colored heart.

4. The method of transferring a sublimable dyestuff art image onto the curved outer surface of a billiard ball as recited in claim 3 wherein said first lithographic art image is dimensioned slightly smaller than said heart shaped plug and having a sublistatic ink border around said undersize red heart image of a color to match the color of the ball on which it is to be printed and of a width sufficient to print said matching color in said plug area as well as overprinting said matching color on said ball just outside said plugged area.

5. The method of transferring a sublimable dyestuff art image onto the curved outer surface of a billiard ball as recited in claim 1 wherein said first predetermined configuration is in the shape of a spade found in a deck of cards.

6. The method of transferring a sublimable dyestuff art image onto the curved outer surface of a billiard ball as recited in claim 1 wherein said polyester resin plug contains a white pigment that makes said plug white in color.

7. The method of transferring a sublimable dyestuff art image onto the curved outer surface of a billiard ball as recited in claim 1 wherein said cuts extend in from the outside edge a distance in the range of 1/16–1/4 inch.

8. The method of transferring a sublimable dyestuff art image onto the curved outer surface of a billiard ball as recited in claim 1 wherein said recess have a depth in the range of 0.02–0.08 inches.

9. The method of transferring a sublimable dyestuff art image onto the curved outer surface of a billiard ball comprising the steps of:

(a) molding a spherically shaped polyester billiard ball with at least one recess having a first predetermined configuration formed in its curved outer surface, said billiard ball being made of a material having a color that is not white;

(b) inserting a plug made of titanium dioxide pigmented styrene polyester resin material into said at least one recess; said plug having said first predetermined configuration and a curved outer surface;

(c) said curved outer surface of said plug then being coated with a clear alkyd resin and melamine formaldehyde resin;

(d) said plug and coating then being heat cured thereby providing said billiard ball with a substantially spherical outer surface;

(e) forming a first lithographic art image on an auxiliary carrier web; said first lithographic art image being made of sublimable dyestuff; said first lithographic art image having an outer edge having substantially the shape of said first predetermined configuration;

(f) making inwardly extending cuts around the outside edge of the perimeter of said first lithographic art image; and (g) hot press heat transfer printing of said first lithographic art image and said sublimable dyestuff onto said curved outer surface of said plug.

10. The method of transferring a sublimable dyestuff art image onto the curved outer surface of a billiard ball as recited in claim 9 wherein said first predetermined configuration is in the shape of a heart.

11. The method of transferring a sublimable dyestuff art image onto the curved outer surface of a billiard ball as recited in claim 10 wherein said lithographic art image is a red colored heart.

12. The method of transferring a sublimable dyestuff art image onto the curved outer surface of a billiard ball as recited in claim 11 wherein said first lithographic art image is dimensioned slightly smaller than said heart shaped plug having a sublistatic ink border around said undersized red heart image of a color to match the color of the ball on which it is to be printed and of a width sufficient to print said matching color in said plug area as well as overprinting said matching color on said ball just outside said plugged area.

13. The method of transferring a sublimable dyestuff art image onto the curved outer surface of a billiard ball as recited in claim 9 wherein said first predetermined configuration is in the shape of a spade such as found in a deck of cards.

14. The method of transferring a sublimable dyestuff art image onto the curved outer surface of a billiard ball comprising the steps of:

(a) molding a spherically shaped polyester billiard ball with at least one recess having a first predetermined configuration formed in its curved outer surface, said billiard ball being made of a material having a color that is not white;

(b) inserting a plug made of styrene polyester resin material into said at least one recess; said plug having said first predetermined configuration and a curved outer surface; there is titanium dioxide white pigmentation in said styrene polyester resin plug having a level of 8 parts +/−6 of pigment per 100 parts of resin to provide a sufficient degree of translucency;

(c) said outer surface of said plug then being coated with a clear alkyd resin and melamine formaldehyde resin;

(d) said plug and coating then being heat cured thereby providing said billiard ball with a substantially spherical outer surface;

(e) forming a first lithographic art image on an auxiliary carrier web; said first lithographic art image being made of sublimable dyestuff; said first lithographic art image having an outer edge having substantially the shape of said first predetermined configuration;

(f) making inwardly extending cuts around the outside edge of the perimeter of said first lithographic art image; and (g) hot press heat transfer printing of said first lithographic art image and said sublimable dyestuff onto said curved outer surface of said plug.

15. The method of transferring a sublimable dyestuff art image onto the curved outer surface of a billiard ball as recited in claim 14 wherein said first predetermined configuration is in the shape of a heart.

16. The method of transferring a sublimable dyestuff art image onto the curved outer surface of a billiard ball as recited in claim 15 wherein said lithographic art image is a red colored heart.

17. The method of transferring a sublimable dyestuff art image onto the curved outer surface of a billiard ball as recited in claim 16 wherein said first lithographic art image is dimensioned slightly smaller than said heart shaped plug and having a sublistatic ink border around said undersized red heart image of a color to match the color of the ball on which it is to be printed and of a width sufficient to print said matching color in said plug area as well as overprinting said matching color on said ball just outside said plugged area.

18. The method of transferring a sublimable dyestuff art image onto the curved outer surface of a billiard ball as recited in claim 14 wherein said first lithographic art image is dimensioned slightly smaller than said heart shaped plug and having a sublistatic black border of a width sufficient to print black on any portion of said exposed white plug and print block on any colored portion just outside said white plug area.

19. The method of transferring a sublimable dyestuff art image onto the curved outer surface of a billiard ball as recited in claim 14 wherein said first predetermined configuration is in the shaped of a spade found in a deck of cards.

20. The method of transferring a sublimable dyestuff art image onto the curved outer surface of a billiard ball as recited in claim 14 wherein said first predetermined configuration is in the shaped of a heart found in a deck of cards.

* * * * *